US010271604B2

(12) United States Patent
Hallander

(10) Patent No.: US 10,271,604 B2
(45) Date of Patent: Apr. 30, 2019

(54) COMFORT PADDING AND A HELMET COMPRISING THE COMFORT PADDING

(71) Applicant: POC Sweden AB, Stockholm (SE)

(72) Inventor: Fredrik Hallander, Alvsjo (SE)

(73) Assignee: POC Sweden AB, Stockholm (SE)

( * ) Notice: Subject to any disclaimer, the term of this patent is extended or adjusted under 35 U.S.C. 154(b) by 0 days.

(21) Appl. No.: 16/024,154

(22) Filed: Jun. 29, 2018

(65) Prior Publication Data

US 2018/0303189 A1 Oct. 25, 2018

Related U.S. Application Data

(63) Continuation of application No. PCT/SE2017/051147, filed on Nov. 20, 2017.

(30) Foreign Application Priority Data

Nov. 22, 2016 (SE) ..... 1651524

(51) Int. Cl.
*A42B 3/06* (2006.01)
*A42C 2/00* (2006.01)
*A42B 3/12* (2006.01)

(52) U.S. Cl.
CPC ..... *A42B 3/128* (2013.01); *A42B 3/064* (2013.01); *A42B 3/127* (2013.01); *A42C 2/00* (2013.01)

(58) Field of Classification Search
CPC ..... A42B 3/128; A42B 3/127; A42B 3/064; A42B 3/12; A42B 3/121; A42B 3/10; A42B 3/145; A42B 3/069; A42C 2/00
USPC ..... 2/411–413, 425
See application file for complete search history.

(56) References Cited

U.S. PATENT DOCUMENTS 3,286,275 A 11/1966 Marchello
3,350,718 A 11/1967 Webb
3,413,656 A 12/1968 Vogliano et al.
3,430,260 A 3/1969 Johnson et al.
3,510,879 A 5/1970 Webb
(Continued)

FOREIGN PATENT DOCUMENTS

CA 2975811 A1 8/2016
EP 0792592 A1 9/1997
(Continued)

OTHER PUBLICATIONS

International Search Report dated Dec. 19, 2016, in International Application No. PCT/SE2016/051033.
(Continued)

*Primary Examiner* — Gloria M Hale
(74) *Attorney, Agent, or Firm* — Downs Rachlin Martin PLLC

(57) ABSTRACT

A comfort padding, configured to be attached at an innermost surface of a helmet, which is facing a wearer's head, for providing a sliding movement in the comfort padding in response to an oblique force applied to the helmet in use is provided. The comfort padding comprises a layer of membrane material provided closer to the helmet than a layer of stretchable fabric or nonwoven material, and between the two layers there is a layer of open cell polymer foam, the membrane layer has a low friction surface allowing for a sliding movement between the layer of open cell polymer foam and the membrane material. A helmet comprising the comfort padding.

19 Claims, 6 Drawing Sheets

(56) References Cited

U.S. PATENT DOCUMENTS

| | | | | |
|---|---|---|---|---|
| 3,599,239 | A | 8/1971 | Tatum | |
| 3,758,889 | A | 9/1973 | Erb | |
| 4,012,794 | A | 3/1977 | Nomiyama | |
| 4,185,331 | A | 1/1980 | Nomiyama | |
| 4,307,471 | A | 12/1981 | Lovell | |
| 5,093,936 | A | 3/1992 | Copeland et al. | |
| 5,633,286 | A | 5/1997 | Chen | |
| 6,560,787 | B2 | 5/2003 | Mendoza | |
| 6,658,671 | B1 * | 12/2003 | Von Hoist | A42B 3/064 2/412 |
| 7,146,652 | B2 | 12/2006 | Ide et al. | |
| 7,376,980 | B2 | 5/2008 | Bullock et al. | |
| 7,930,771 | B2 * | 4/2011 | Depreitere | A42B 3/124 2/410 |
| 8,578,520 | B2 * | 11/2013 | Halldin | A42B 3/064 2/411 |
| 9,414,632 | B1 * | 8/2016 | Dougherty | A42B 3/069 |
| 9,603,406 | B2 * | 3/2017 | Halldin | A42B 3/064 |
| 2001/0032351 | A1 * | 10/2001 | Nakayama | A42B 3/064 2/412 |
| 2002/0002730 | A1 | 1/2002 | Dennis et al. | |
| 2004/0117896 | A1 | 6/2004 | Madey et al. | |
| 2004/0168246 | A1 | 9/2004 | Phillips | |
| 2004/0250340 | A1 * | 12/2004 | Piper | A42B 3/064 2/411 |
| 2006/0059606 | A1 | 3/2006 | Ferrara | |
| 2007/0190292 | A1 | 8/2007 | Ferrara | |
| 2008/0066217 | A1 | 3/2008 | Depreitere et al. | |
| 2008/0155735 | A1 | 7/2008 | Ferrara | |
| 2009/0260133 | A1 | 10/2009 | Del Rosario | |
| 2009/0302509 | A1 * | 12/2009 | Debiasi | B29C 44/06 264/511 |
| 2010/0115686 | A1 * | 5/2010 | Halldin | A42B 3/064 2/422 |
| 2011/0167542 | A1 | 7/2011 | Bayne et al. | |
| 2013/0040524 | A1 * | 2/2013 | Halldin | B32B 5/022 442/326 |
| 2013/0150473 | A1 * | 6/2013 | Miyazaki | C08G 18/4072 521/116 |
| 2013/0283505 | A1 | 10/2013 | Futterer | |
| 2015/0264993 | A1 | 9/2015 | Vito et al. | |
| 2016/0073723 | A1 | 3/2016 | Halldin et al. | |
| 2018/0213874 | A1 | 8/2018 | Lanner et al. | |

FOREIGN PATENT DOCUMENTS

| | | | |
|---|---|---|---|
| EP | 1142495 | A1 | 10/2001 |
| EP | 2440082 | B1 | 3/2015 |
| GB | 1114214 | A | 5/1968 |
| GB | 2015323 | A | 9/1979 |
| GB | 2423006 | A | 8/2006 |
| SE | 1050458-7 | | 1/2013 |
| WO | 199614768 | | 5/1996 |
| WO | 200145526 | A1 | 6/2001 |
| WO | 2006022680 | A1 | 3/2006 |
| WO | 2008103107 | A1 | 8/2008 |
| WO | 2009152795 | A1 | 12/2009 |
| WO | 2011087435 | A1 | 7/2011 |
| WO | 2011139224 | A1 | 11/2011 |
| WO | 2013104073 | A1 | 7/2013 |
| WO | 2016128404 | A1 | 8/2016 |
| WO | 2017148958 | A1 | 9/2017 |
| WO | 2017151028 | A1 | 9/2017 |
| WO | 2017157765 | A1 | 9/2017 |

OTHER PUBLICATIONS

International Search Report dated Feb. 9, 2018, in International Application No. PCT/SE2017/051147.
U.S. Appl. No. 61/333,817, filed May 12, 2010.
U.S. Appl. No. 15/209,653, filed Jul. 13, 2016.
U.S. Appl. No. 15/586,154, filed May 3, 2017.
www.hivissupply.com/jsp-evolution-deluxe-6161-full-brim-hard-hat.html. JSP Evolution Deluxe 6161 Full Brim Hard Hat. Last viewed on Jun. 18, 2018.

* cited by examiner

COMFORT PADDING AND A HELMET COMPRISING THE COMFORT PADDING

RELATED APPLICATION DATA

This application is continuation of International Application No. PCT/SE2017/051147, filed on Nov. 20, 2017, and titled "A Comfort Padding and A Helmet Comprising The Comfort Padding," which claims priority to Swedish Patent Application No. 1651524-9, filed on Nov. 22, 2016, each of which is incorporated by reference herein in its entirety.

FIELD OF THE INVENTION

The present invention concerns a comfort padding and a helmet comprising the comfort padding.

BACKGROUND

The understanding of how oblique impacts affects the brain of a person is increasingly growing and so also the different ways of taking care of oblique impacts towards helmets. Different solutions have been provided, such as having a sliding layer arranged between a shell and an energy absorbing layer, or between two energy absorbing layers. According to European Patent No. 2440082 an attachment device for attachment to a wearer's head is provided, which is fixed to the inside of the energy absorbing layer, and where a sliding occurs between the attachment device and the inside of the energy absorbing layer. In WO2013/10473 a bladder comprising a low friction liquid or gel is shown which is provided to manage the angular forces separately from the compressive forces. The compressive forces are to be managed by the liner.

SUMMARY OF THE DISCLOSURE

The aim of the present invention is to provide a functionally effective yet cost effective way of providing increased head safety for a person carrying out any type of sport or the like needing a helmet.

The solution according to the present invention is to provide a sliding movement closer to the person's head by having the sliding movement to occur within comfort padding instead of in the helmet. Usually a helmet comprises an outer shell (although optional), an energy absorbing layer (often called a liner) and on the innermost side of the energy absorbing layer, facing the wearer, at least one comfort padding. The comfort padding may be one piece reaching to different positions inside the helmet or several patches at desired positions to add comfort for the wearer between the head and the energy absorbing layer, which usually is made of EPS or sometimes EPP, although other materials are conceivable, too. A comfort padding has an overall flat configuration in one plane. When attached in a helmet it follows the innermost surface of the helmet, which will make up a plane of sliding movement.

The sliding plane may, depending on the position in the helmet and size of the comfort padding, be almost flat to curved.

A comfort padding has usually a fabric material both at a side to be attached against the inside surface of the helmet and at a side to abut against a wearer's head. Between the fabric sides a polymer foam is provided. Comfort paddings are usually attached in a fixed yet detachable way, which may be accomplished by means of using hook and loop material, such as VELCRO®.

According to a first aspect of the present invention is a comfort padding provided configured to be attached at an innermost surface of a helmet, which is facing a wearer's head, for providing a shearing and sliding movement in the comfort padding in response to an oblique force applied to the helmet in use. The comfort padding comprises a layer of membrane material provided closer to the helmet than a layer of stretchable fabric or nonwoven material, and between the two layers there is a layer of elastic, porous material. The membrane layer has a low friction surface allowing for a sliding movement between the layer of open cell polymer foam and the membrane material.

According to an embodiment the membrane layer and the layer of stretchable fabric or nonwoven material are interconnected along the rims so as to provide a closed space, in between the layers, comprising the layer of elastic, porous material. The layer of elastic, porous material is freely movable inside of the closed space. The layer of elastic, porous material may shear during an oblique impact.

According to an embodiment a layer of fabric or nonwoven material is attached to the layer of elastic, porous material on the side facing the membrane layer.

According to an embodiment the comfort padding comprises layers, seen from the inner side facing a wearer's head in use, the stretchable fabric or nonwoven material, the layer of elastic, porous material, the attached fabric or nonwoven material, the membrane layer, and a connection material attached to the side of the membrane layer facing the innermost surface of the helmet.

According to an embodiment the connection material of the padding configured to attach to the innermost side of a helmet is loopy or roughened in order to attach to for example hook material such as VELCRO®.

According to an embodiment the layer of fabric or nonwoven material is a wicking material.

According to an embodiment the comfort padding is in the form of patches.

According to a second aspect of the present invention a helmet is provided, comprising an energy absorbing layer, comprising at least one part, having an outer side facing away from a wearer's head and an innermost side facing the wearer's head, at least one piece of comfort padding according to any one of the previous claims, provided at the innermost side of the energy absorbing layer.

Thus an inventive comfort padding have been provided which has superior possibilities to handle oblique impacts. Since the sliding occurs inside the comfort padding the rotational force of the oblique impact will be handled as close to the head as possible thus limiting the torque of the head. Additionally, the comfort padding will be very light weight due to the layer of elastic, porous material, which also is an important safety factor of a helmet.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

Figure 1:
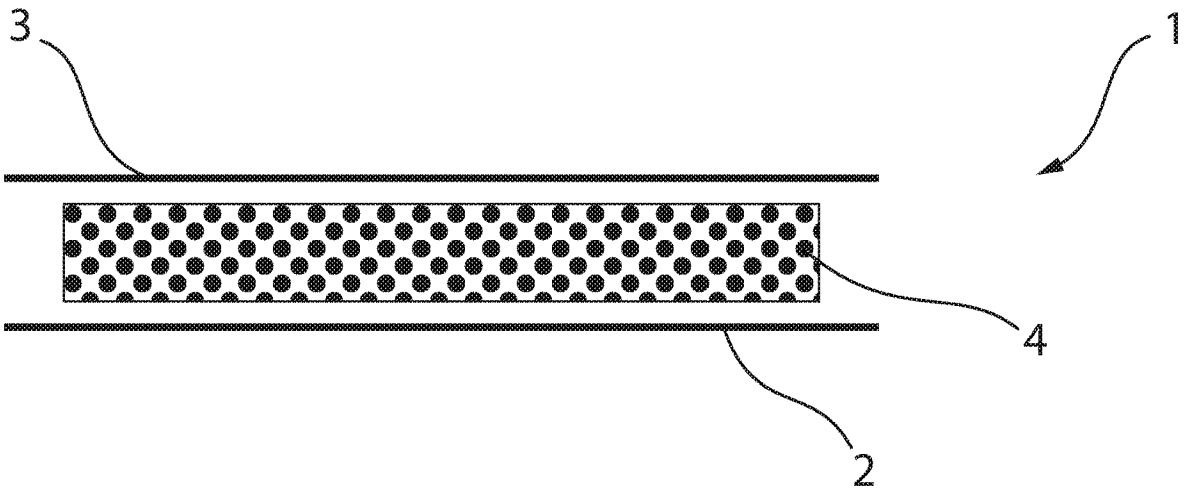
FIG. 1 shows one embodiment of a comfort padding in cross sectional view.

In FIG. 1 a comfort padding 1 is shown per se. It comprises a first layer 2, which is to be positioned towards a helmet, at the innermost surface of a helmet, such as an energy absorbing layer. The first layer 2 is a layer of membrane material. The membrane material has a low friction surface.

FIG. 1 also shows a second layer 3, which is to be positioned closest to a wearer's head 16. This layer 3 is a layer of fabric or nonwoven material and is stretchable. The material is preferably a material which feels nice and comfortable against the skin of the wearer. It could also have wicking properties in order to lead sweat from the wearer into the material and thereafter vaporisation of the sweat. In between the two layers 2, 3 a layer or cushion of elastic, porous material 4 is present.

The membrane layer 2 has a low friction surface and thus will allow for a sliding movement, between the layer of elastic, porous material 4 and the membrane layer 2, in response to an oblique impact. Thus the sliding movement will occur within the comfort padding 1. The layer of elastic, porous material will provide comfort to the wearer and also facilitate sweat vaporization.

Figure 2:
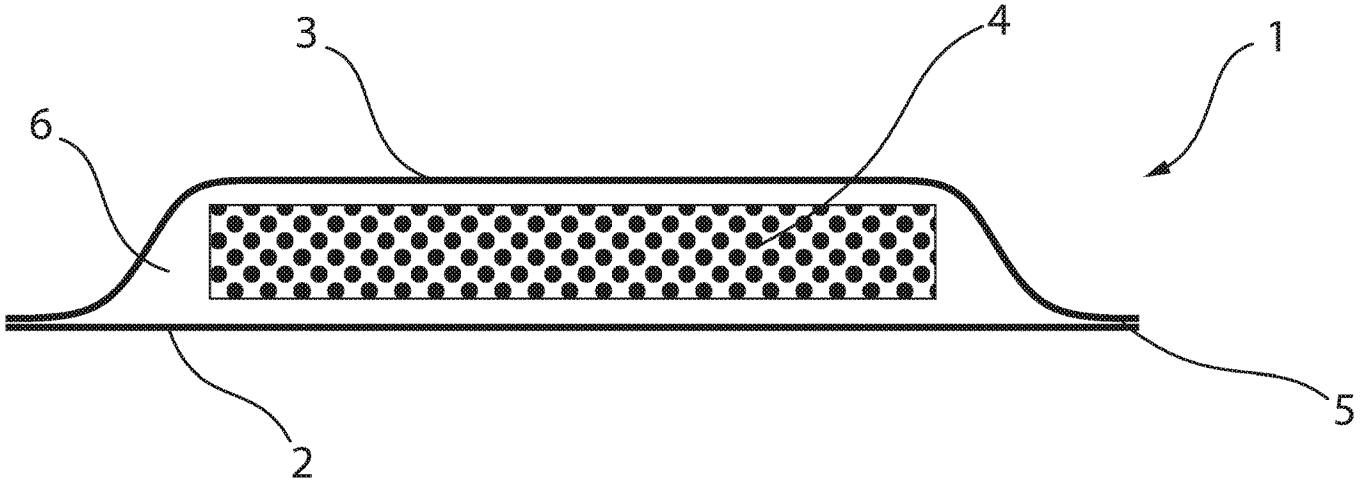
FIG. 2 shows a further embodiment of a comfort padding in cross sectional view having interconnected rims.

In FIG. 2 a further embodiment of the comfort padding 1 is shown in cross sectional view. In the present figure the two layers 2, 3 are interconnected along their rims 5 providing a closed space 6. The layer or cushion of elastic, porous material 4 is freely movable inside of the closed space 6.

Figure 3:
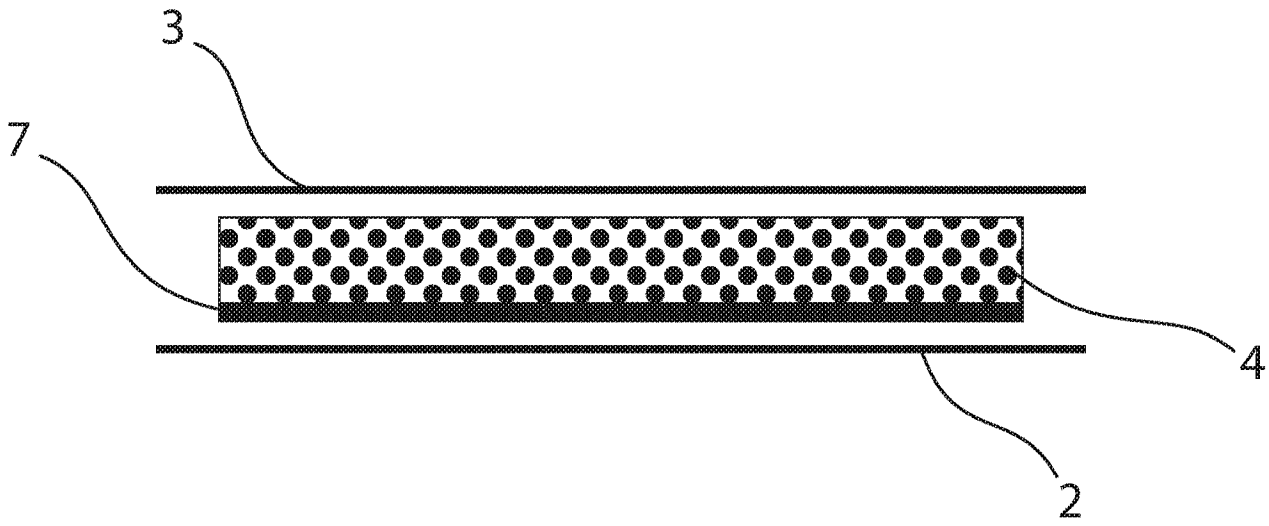
FIG. 3 shows another embodiment of a comfort padding in cross sectional view.

In FIG. 3 a further embodiment of the comfort padding 1 is shown in cross sectional view. A layer 7 of fabric or nonwoven material is attached to the layer of elastic, porous material 4, for example by means of laminating. Preferably, the first and second layers 2, 3 may be interconnected along its edges 5 (not shown).

Figure 4:
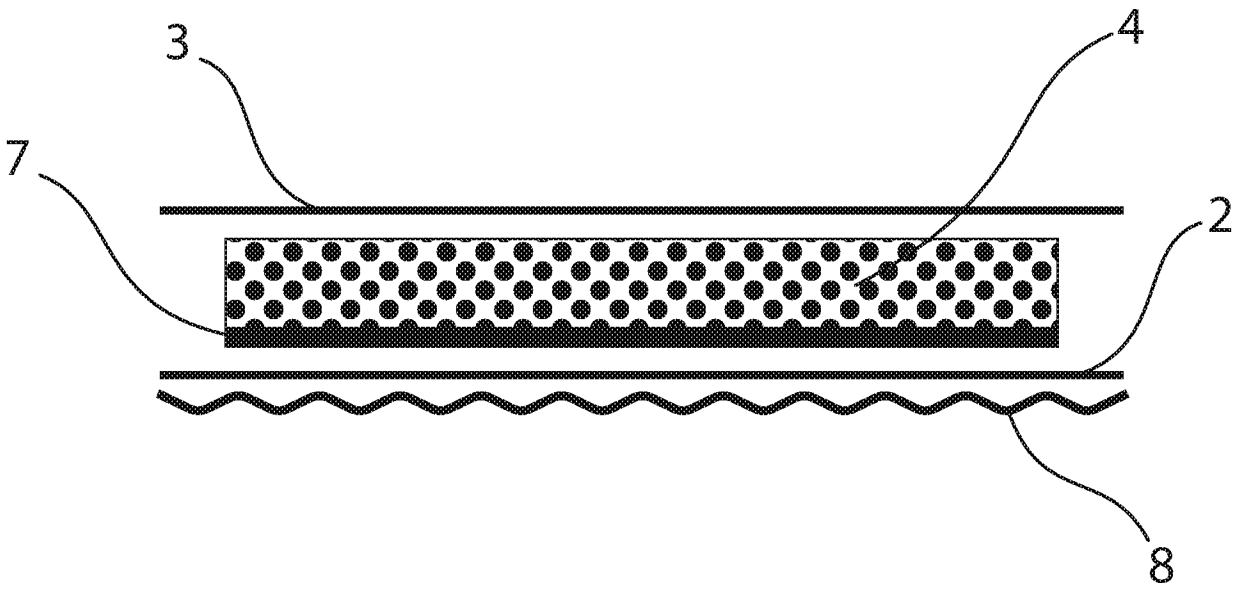
FIG. 4 shows one embodiment of a comfort padding in cross sectional view.

In FIG. 4 an embodiment of the comfort padding 1 comprises layers is shown. Seen from the inner side facing a wearer's head in use the comfort padding 1 comprises the stretchable fabric or nonwoven material 3, the layer of elastic, porous material 4, the attached fabric or nonwoven material 7, the membrane layer 2, and a connection material 8 attached to the side of the membrane layer 2 facing the innermost surface of the helmet. The connection material 8 of the comfort padding 1 configured to attach to the innermost side of a helmet is loopy or roughened in order to attach to for example hook material such as VELCRO®. This connection material 8 may be laminated on the membrane layer 2, on the side facing the helmet.

Figure 5:
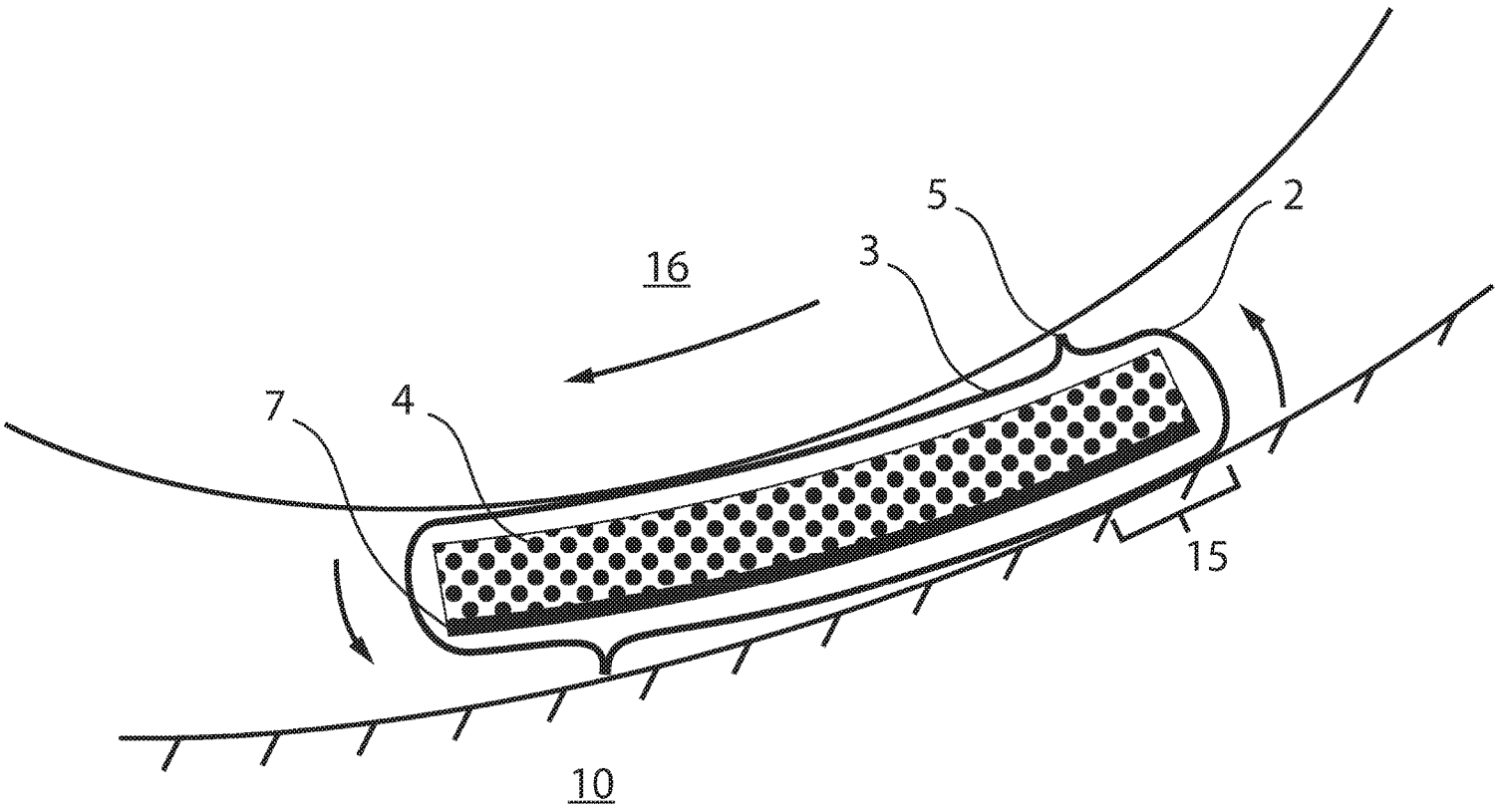
FIG. 5 shows a cross section of an embodiment of a padding during an oblique impact.

In FIG. 5 it is shown when a helmet 9 is exposed to an oblique impact and how the comfort padding 1 may move in addition to the inner sliding movements. The comfort padding 1 may roll somewhat, up to the fastening/connection 15 to an innermost side 14 of an energy absorbing layer 10 of a helmet 9. It is not a sliding movement between the comfort padding 1 and the inside 14 of the energy absorbing layer 10 since the comfort padding 1 is fastened/connected to the inside 14, for example by means of VELCRO®. For example, the connection 15 does not cover the full area of the comfort padding but instead only a portion in order to render partial rolling of the comfort padding possible. In case the oblique impact is stronger, the comfort padding 1 may start to be torn off from the inside 14 of the energy absorbing layer 10, see also FIG. 8. This rolling movement is possible due to the stretchable second layer 3.

The membrane layer 2 material having a low friction surface may be any material having a coating of a low friction material or made of a material having low friction itself. The membrane material layer may be thin, for example a few hundredth of a millimeter or thicker, to give some stability to the comfort padding 1, for example a few tenth of a millimeter.

The layer of elastic, porous material may have a thickness of 4-10 mm. It could be an open cell foam, for example a foam of Polyethylene (PE) or similar, having a density between 5-50 kg/m3. Alternatively, the layer of elastic, porous material may be a fibre material, such as a wadding or non-woven felt having a three dimensional structure of fibres so that the air permeability is high and thus the density is low. In such a way the layer of elastic, porous material may not accumulate sweat vapour but instead lead it out. The density may be between 20-50 kg/m3 (JIS-K-6401) and the air permeability may be between 90-150 cm3/cm2 sec (JIS-L-1079). A suggested material is a non-woven material with more or less vertically oriented fibres, i.e. radially oriented fibres when in use in the comfort padding in a helmet and worn by a wearer. For example the fibres may be of polyesther or a polysulfone, such as a polyether sulfone (PES).

The sliding movement is preferably at least 5 mm, preferably at least 5-10 mm and most preferred at least 10 mm or more.

In all shown embodiments it is preferred that the second layer 3 is made of a flexible and stretchable fabric or a flexible and stretchable nonwoven material. It is preferably knitted and may comprise yarn of elastan, LYCRA®, spandex, polyester or nylon.

As the person skilled in the art understands it is possible to mix, pick and choose from the suggested materials in any way as long it is not contradicting the inventive idea of a sliding and a shearing movement within the comfort padding in response to an oblique impact.

Figure 6:
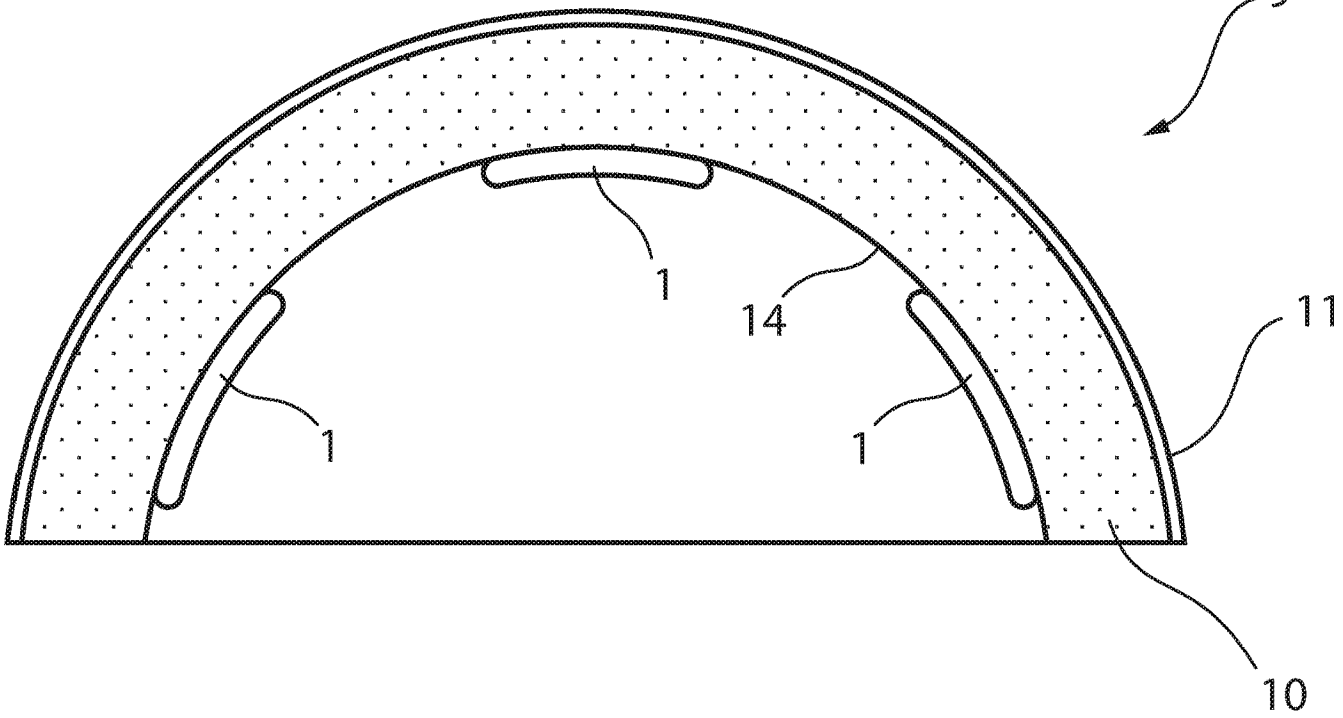
FIG. 6 shows a comfort padding in a helmet, seen in a cross sectional view.

In FIG. 6 at least one comfort padding 1 of any embodiment of the present invention is provided at the innermost surface 14 of a helmet 9. The helmet 9 comprises an energy absorbing layer 10 and preferably an outer shell 11.

The presently described embodiments are only examples and shall not be seen as limiting the scope of the invention, which is presented in the claims.

The foregoing has been a detailed description of illustrative embodiments of the invention. It is noted that in the present specification and claims appended hereto, conjunctive language such as is used in the phrases "at least one of X, Y and Z" and "one or more of X, Y, and Z," unless specifically stated or indicated otherwise, shall be taken to mean that each item in the conjunctive list can be present in any number exclusive of every other item in the list or in any number in combination with any or all other item(s) in the conjunctive list, each of which may also be present in any number. Applying this general rule, the conjunctive phrases in the foregoing examples in which the conjunctive list consists of X, Y, and Z shall each encompass: one or more of X; one or more of Y; one or more of Z; one or more of X and one or more of Y; one or more of Y and one or more of Z; one or more of X and one or more of Z; and one or more of X, one or more of Y and one or more of Z.

Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A helmet, comprising:

an interior surface configured to face a wearer's head; and a pad attached to the interior surface, the pad including:

a stretchable layer configured, when the helmet is in use, to come into contact with a wearer's head and stretch in response to an oblique force applied to the helmet;

a membrane layer; and an elastic, porous material located between the stretchable layer and the membrane layer, the elastic, porous material designed and configured to slide along the membrane layer in response to the oblique force;

wherein the membrane layer has a low friction surface configured to allow the sliding of the elastic, porous material in response to the oblique force applied to the helmet.

2. The helmet according to claim 1, wherein the membrane layer and the stretchable layer each have rims and are interconnected along their respective rims so as to provide a closed space therebetween, the elastic, porous material located and freely moveable within the closed space.

3. The helmet according to claim 1, wherein the elastic, porous material has a first side facing the membrane layer and an opposite side facing the stretchable layer, the pad further comprising an intermediate layer of material attached to the first side of the elastic, porous material, the intermediate layer configured to slide against the membrane layer.

4. The helmet according to claim 3, further comprising a connection material attached to a side of the membrane layer facing the surface of the helmet for attaching the pad to the helmet.

5. The helmet according to claim 4, wherein the connection material is loopy or roughened and configured to attach to a hook material located on the interior surface of the helmet.

6. The helmet according to claim 1, wherein the pad is comfort pad and the stretchable layer is a wicking material.

7. The helmet according to claim 1, wherein the pad is configured as a patch.

8. A helmet, comprising:

an interior surface configured to face a wearer's head; and a pad attached to the interior surface, the pad including:

an inner stretchable layer configured to come into contact with a wearer's head;

an outer layer adjacent the interior surface of the helmet, the outer layer having a low friction surface on a side of the outer layer facing the inner layer; and an elastic material disposed between the inner and outer layers;

wherein, in response to an oblique force applied to the helmet when the helmet is in use, the elastic material is designed and configured to slide along the low friction surface and shear.

9. The helmet of claim 8, wherein the outer layer is attached to the helmet and includes an attachment portion directly attached to the helmet and a rolling portion, the rolling portion configured to be displaced from the helmet and roll relative to the attachment portion in response to the oblique force applied to the helmet.

10. The helmet of claim 8, further comprising an intermediate layer of material, the intermediate layer attached to a side of the elastic material facing the outer layer, the intermediate layer configured to slide against the outer layer.

11. The helmet of claim 8, wherein the elastic material includes at least one of an open cell foam and a non-woven fiber material.

12. The helmet of claim 11, further comprising an intermediate layer of material laminated to a side of the elastic material facing the outer layer.

13. The helmet of claim 8, wherein the elastic material comprises fibers oriented substantially perpendicular to a surface of the outer layer.

14. The helmet of claim 8, wherein the elastic material has an air permeability between 90 cm3/cm2 sec and 150 cm3/cm2 sec and a density between 20 kg/m3 and 50 kg/m3 to facilitate vaporization of sweat.

15. A method of manufacturing a comfort padding for use in a helmet, the method comprising:

receiving a stretchable inner layer configured to come into contact with a wearer's head when the helmet is in use and an outer layer configured to be attached to an inner surface of the helmet;

receiving an elastic material; and disposing the elastic material within an enclosed space defined by the inner and outer layers, wherein the elastic material is freely moveable within the enclosed space and the disposing includes providing at least one sliding interface designed and configured to provide relative sliding movement between the elastic material and the outer layer in response to an oblique force applied to the helmet when the helmet is in use that results in a stretching of the stretchable inner layer and corresponding expansion of the enclosed space.

16. The method of claim 15, further comprising attaching an intermediate layer of material to a side of the elastic material facing the outer layer, the intermediate layer providing a portion of the sliding interface.

17. A method of using a helmet that includes at least one comfort padding secured to an inner surface of the helmet, the at least one comfort padding including:

inner and outer layers; and an elastic material disposed between the inner and outer layers and located in a space defined at least in part by the inner layer;

the method comprising:

positioning the helmet on a wearer's head so that the inner layer directly contacts the wearer's head; and in response to an oblique force applied to the helmet, stretching the inner layer, sliding the elastic material within the space, shearing the elastic material, and rolling a portion of the comfort padding, to thereby absorb a portion of the oblique force with the comfort padding.

18. The helmet according to claim 1, wherein the elastic, porous material is located within an enclosed space defined at least in part by the stretchable layer, wherein the stretching of the stretchable layer in response to the oblique force increases a size of the enclosed space thereby facilitating the sliding of the elastic, porous material.

19. The helmet according to claim 1, wherein the pad is a comfort pad, the stretchable layer having wicking properties and/or the elastic, porous material providing at least one of cushioning and facilitating sweat vaporization, to provide comfort to the wearer.

* * * * *